US005621308A

United States Patent [19]

Kadanka et al.

[11] Patent Number: 5,621,308

[45] Date of Patent: Apr. 15, 1997

[54] ELECTRICAL APPARATUS AND METHOD FOR PROVIDING A REFERENCE SIGNAL

[76] Inventors: Petr Kadanka, B. Nemcove, Rosnov p. R., 75661, Czechoslovakia; Robert L. Vyne, 5623 S. Holbrook Ln., Tempe, Ariz. 85283

[21] Appl. No.: 609,252

[22] Filed: Feb. 29, 1996

[51] Int. Cl.[6] ..... G05F 3/16; G05F 3/20

[52] U.S. Cl. ..... 323/315; 323/313

[58] Field of Search ..... 323/313, 315

[56] References Cited

U.S. PATENT DOCUMENTS

| | | | |
|---|---|---|---|
| 5,446,368 | 8/1995 | Uscategui | 323/315 |
| 5,479,092 | 12/1995 | Pigott et al. | 323/313 |
| 5,512,816 | 4/1996 | Lambert | 323/315 |
| 5,530,340 | 6/1996 | Hayakawa et al. | 323/315 |

*Primary Examiner*—Peter S. Wong
*Assistant Examiner*—Bao Q. Vu
*Attorney, Agent, or Firm*—Robert M. Handy; Robert D. Atkins

[57] ABSTRACT

A band-gap voltage reference (39) has a regulator portion (70) providing a substantially constant current of predetermined magnitude Ic and a band-gap reference portion (72) receiving Ic. The reference portion (72) has a first branch including a first transistor (52) of a first type serially coupled to a second transistor (55) of a second type, a second branch including a third transistor (53) of the first type serially coupled to a fourth transistor (56) of the second type, the first and second branches forming a current mirror (73) carrying a total current of about Ic/2, and a third branch (57) in parallel with the first and second branches and carrying a current of substantially Ic-Ic/2. Base current (65) in the first two branches is compensated by base current (64) of the third branch.

13 Claims, 2 Drawing Sheets

39

ELECTRICAL APPARATUS AND METHOD FOR PROVIDING A REFERENCE SIGNAL

FIELD OF THE INVENTION

The invention concerns an apparatus and method for providing a voltage reference.

BACKGROUND OF THE INVENTION

Voltage reference circuits are widely used in the electronics art, particularly integrated voltage reference circuits fabricated in semiconductor microchips. A well known technique for obtaining a voltage reference is to utilize the inherent band-gap energy of the semiconductor in or on which an integrated circuit (IC) micro-chip is fabricated. In the case of silicon based IC's, the band gap energy is about 1.1 electron-volts.

FIG. 1 shows typical prior art band-gap voltage reference circuit 9 comprising resistors 10, 16, 28, 29 and 31, capacitor 30, NPN transistors 12, 13, 24, 25, 26, and 32 and PNP transistors 14, 15, 17, 18, 22, 23, and 27, connected as shown. Terminal 33 is coupled to the supply voltage (Vsup), terminal 34 to the reference voltage (Vg), e.g., ground, and terminal 35 provides the reference voltage (Vref) output.

Transistors 22 and 23 form a PNP current mirror. Influence of their base currents is compensated by resistor 16. The influence of the base current of transistor 27 is compensated by the base current of transistor 15. In order to achieve good compensation, resistor 16 must have a relatively precise value. Unfortunately, it is difficult in the manufacture of IC's to maintain a precise resistor value during manufacturing. That is, the statistical variations in the manufacturing process cause the value of resistor 16 in different microchips made in the same production line to vary. This adversely affects the yield and performance of the finished products, e.g., regulators and other circuits which employ reference circuits of the type illustrated in FIG. 1. A further complication is that the value of resistor 16 is usually temperature dependent. This causes; the reference voltage being supplied at output terminal 35 of circuit 9 to vary as the chip temperature varies. This is undesirable. For these and other reasons, there continues to be a need for improved voltage reference circuits and apparatus in which sensitivity to process and temperature variations is reduced.

DETAILED DESCRIPTION OF THE DRAWINGS

Figure 2:
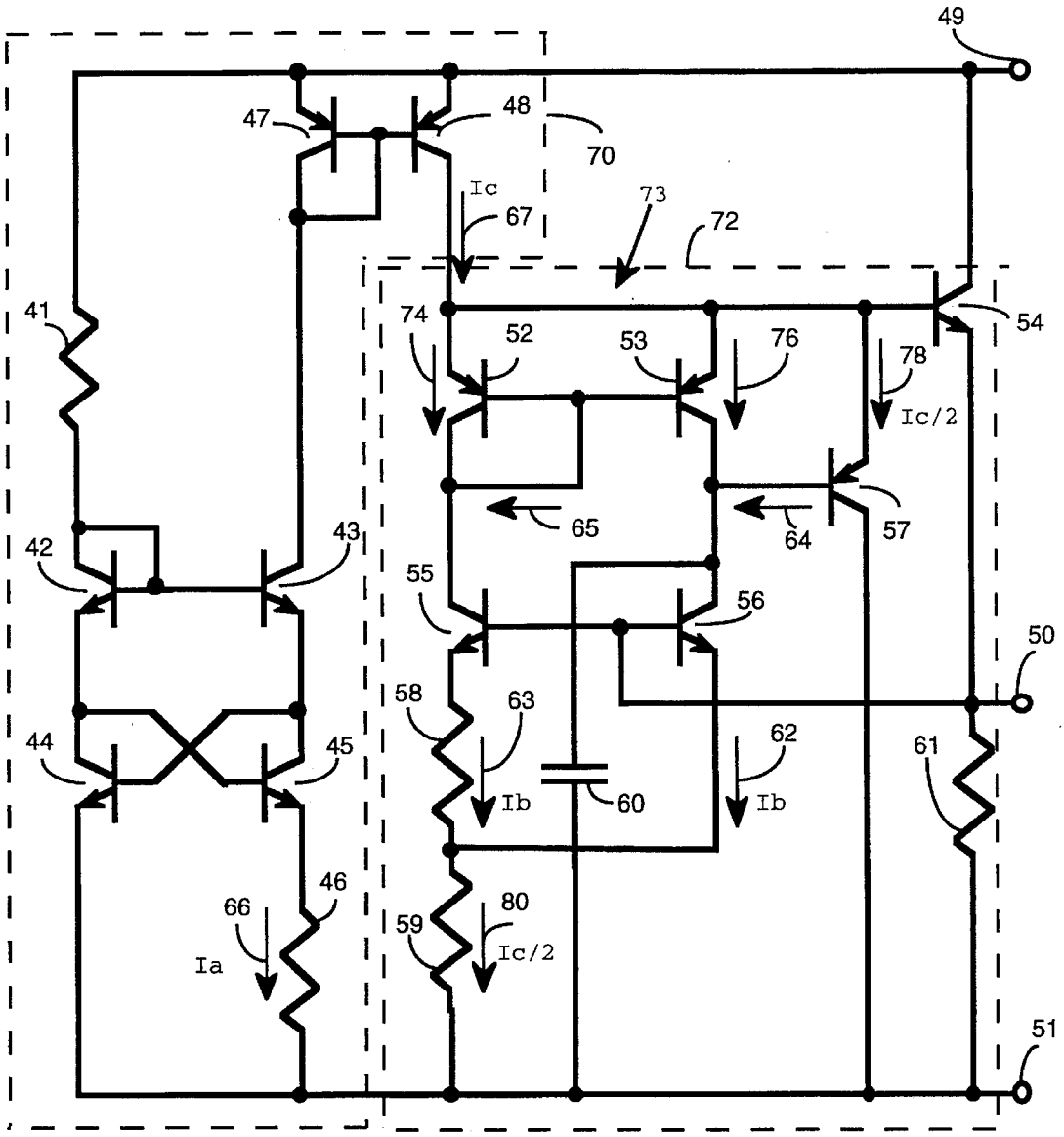
FIG. 2 is a simplified schematic diagram of a voltage reference circuit according to the present invention.

FIG. 2 is a simplified schematic diagram of voltage reference circuit 39 according to the present invention. Circuit 39 comprises resistors 41, 58, 59 and 61, capacitor 60, NPN transistors 42, 43, 44, 45, 54, 55 and 56 and PNP transistors 47, 48, 52, 53 and 57, connected substantially as shown. Terminal 49 is coupled to the supply voltage (Vsup), terminal 51 to the circuit ground (Vg), and terminal 50 provides the reference voltage (Vref) output.

Circuit 39 has two portions, regulator portion 70 which supplies current 67 of magnitude Ic and band-gap reference portion 72 which uses current 67 to drive current mirror 73 such that currents 74, 76 through transistors 52, 53 are equal and their base current 65 is compensated by base current 64.

Capacitor 60 provides frequency compensation of band-gap reference portion 72. Resistor 41 provides start-up current for regulator portion 70.

It is desirable that transistor 45 of regulator portion 70 has a larger emitter area than transistor 44, that is, that the emitter area of transistor 45 be N times the emitter area of transistor 44, where N desirably has values of about $1 \leqq N \leqq 20$ and more conveniently of about $4 \leqq N \leqq 16$, and preferably of about N=8. The value of output current 66 of magnitude Ia through transistors 43, 45, 47 is given by Equation (1) below:

$$Ia=[(kT/q)*ln(N)]/Ra,$$

where Ra is the value of resistor 46, k is Boltzman's Constant, T is temperature in degrees Kelvin, q is the electronic charge and * indicates a multiply operation.

Currents 62 and 63 of magnitude Ib, like currents 74, 76 are substantially the same. It is desirable that transistor 55 has a larger emitter area than transistor 56, that is, that the emitter area of transistor 55 be M times the emitter area of transistor 56, where M desirably has values of about $1 \leqq M \leqq 20$ and more conveniently of about $4 \leqq M \leqq 16$, and preferably of about M=8. The value of output current 63 of magnitude Ib through transistor 55 and resistor 58 (and therefore current 62 through transistor 56) is given by Equation (2) below:

$$Ib=[(kT/q)*ln(M)]/Rb, \quad (2)$$

where Rb is the value of resistor 58 and k, q, T and * have the same meaning as in Equation (1).

The magnitude Ic of current 67 is given by the value of current 66 (Ia) and the ratio P of the emitter area of transistor 48 to the emitter area of transistor 47, that is:

$$Ic=P*Ia. \quad (3)$$

If the magnitude Ic of current 67 is 4 times current 62, 63 (Ib), that is:

$$Ic=4*Ib, \quad (4)$$

then Equations (1–4) can be combined to give Equations (5–6) below:

$$P*Ia=4*Ib, \quad (5)$$

$$[ln(N)/ln(M)]I*P=4*(Ra/Rb), \quad (6)$$

where P desirably has values of about $1 \leqq P \leqq 6$ and more conveniently of about $1 \leqq P \leqq 4$, and preferably of about P=2. It is desirable that P be an integer and that N and M have the about the same value.

Current 67 (Ic) is split to emitters of transistors 52, 53 and 57. The base current of transistor 54 is negligible. Current 74 through transistor 52 and current 76 through transistor 53 are in the same proportion as current 62 (Ib) and currents 74 and 76 are each about Ic/4 and together are about Ic/2. The current through transistor 57 is Ic/2. This means that base current 64 of transistor 57 is the same magnitude as base current 65 which is the sum of the base currents of transistors 52 and 53. Thus, base current 65 is fully compensated by base current 64 of transistor 57. Transistors 52 and 53 desirably (but not essentially) have substantially the same emitter area. Transistor 57 is desirably a two emitter device so as to achieve the same current density as transistors 52, 53 while carrying, e.g., twice the current.

As those of skill in the art will appreciate based on the description herein, it is not necessary that resistors 46 and 58 (or the other resistors in circuit 39) have precise values. What is important is that the ratios of resistors 46, 58 be substantially independent of temperature and process variations. This can be much more easily achieved in practice than to assure the absolute value of a resistor, as is required, for example of resistor 16 in circuit 9 of FIG. 1. It will further be noted that since the transistors and resistors of circuit 39 are generally fabricated at the same time on or in the same semiconductor substrate, transistors 52, 53 and 57 will have substantially identical temperature characteristics so that base currents 65 and 64 remain well matched despite process variations or temperature variations or both.

While various values can be chosen for N, M, P, Ra and Rb, it is important that the values selected are such that Ic=4*Ib. It is convenient that resistors 46 (Ra) and 58 (Rb) have values that are integer multiples. Non-limiting examples are, Ra=5000 Ohms and Rb=10,000 Ohms. It is desirable that N and M be integers, but that is not essential. By way of example, for N=M and Rb=2Ra, then choosing P=2 insures that Ic=4*Ib. Having Ic=4*Ib provides good matching of base currents 65 and 64. The values of resistor 59 is chosen to achieve the desired band-gap reference voltage, e.g., approximately 1.23 volts, on terminal 50. Resistor 61 is not critical and a value of about $10^5$ Ohms is suitable.

It will be further apparent to those of skill in the art based on the description herein that the present invention provides a method for operating an electrical apparatus having a regulator portion for providing a substantially constant current of predetermined magnitude Ic and a band-gap reference portion receiving the substantially constant current and comprising a first branch including a first transistor of a first type serially coupled to a second transistor of a second type, a second branch including a third transistor of the first type serially coupled to a fourth transistor of the second type, and a third branch in parallel with the first and second branches, the method comprising the steps of operating the first and second branches as a current mirror carrying a total current of about Ic/2, and operating the third branch to carry a current of substantially Ic-Ic/2.

While it is especially convenient that N, M and P have the values or ratios noted above, the invented arrangement can be viewed more generally. For example, the following equation applies (see FIG. 2):

$$\text{current } 78 = \text{current } 67 - (\text{current } 74 + \text{current } 76). \quad (7)$$

The important thing is that:

$$\text{current } 65 = \text{current } 64, \quad (8)$$

where current 65 is the sum of the base currents of transistors 52 and 53 and current 64 is the base current of transistor 57. If transistors 52 and 53 are substantially identical, then equation (8) is satisfied by having the ratio between current 76 (Ic) and currents 74, 76 (Ib) equal four, that is Ic=4*Ib, but this is not essential.

The current Ic is generated by the temperature dependent voltage which is given by the difference between Vbe voltages of transistors 44 and 45 divided by the value of resistor 46. With the arrangement of FIG. 2, currents 74 and 76 are also given by the difference between the Vbe voltages of transistors 55 and 56 divided by the value of resistor 58. With this arrangement, currents 74, 76, 78 have the same temperature coefficient and also currents 65, 64 have the same temperature coefficient. In this manner it is possible to use base current 64 of transistor 57 to compensate the influence of current 65 over a wide range of temperature. This is most easily accomplished when transistors 52 and 53 are substantially identical and transistor 57 is of the same type but with twice the emitter area so that Ic=4*Ib, but other combinations of device sizes and arrangements which provide such temperature compensated currents can also be used.

The present invention can be modified by connecting the collector of transistor 57 to output node 50 rather than ground node 51. In this situation, Vbc of transistor 57 is very close to the Vbc's of transistors 52, 53 which are at or near zero. Vbc of transistor 52 is zero due to the diode connection and Vbc of transistor 53 is near zero. In this case, the values of currents 65, 64 are not affected substantially by the differences in Vbc of transistors 57 and 52, 53. However, it is important that the current through resistor 61 determined by the output reference voltage on terminal 50 divided by the value of resistor 61 is larger than current 78 through transistor 57.

Figure 1:
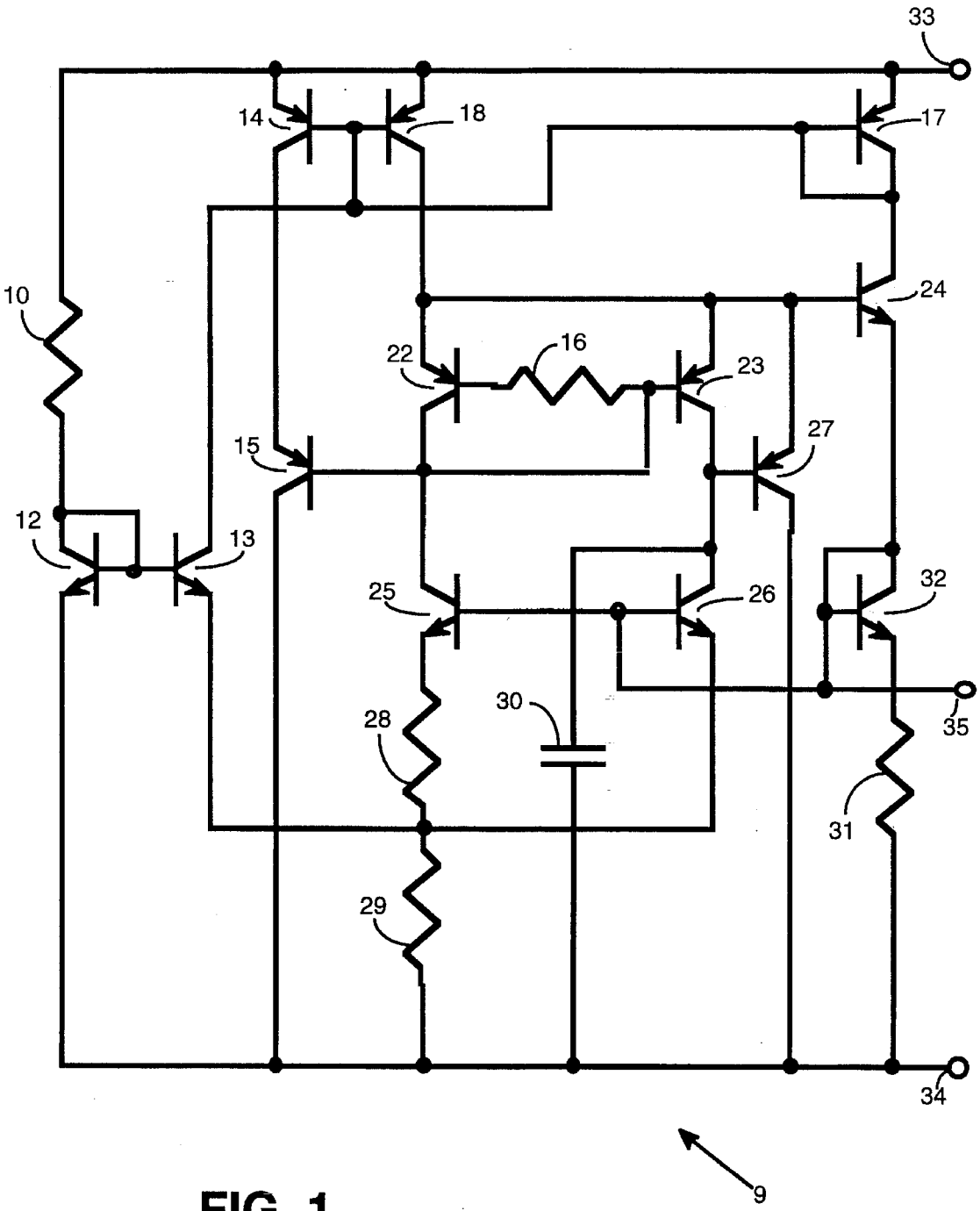
FIG. 1 PRIOR ART
FIG. 1 is a simplified schematic diagram of a voltage reference circuit according to the prior art.

It will be apparent to those of skill in the art that the present invention provides a voltage reference source that is easier to fabricate in integrated form, that is less disturbed by manufacturing process variations and that provides improved temperature stability as compared to the arrangement of FIG. 1. These are highly desirable features.

We claim:

1. An electrical apparatus, comprising:

a regulator portion with a first branch having a first transistor and a second branch having a second transistor, the regulator portion providing a substantially constant current of predetermined magnitude Ic;

a band-gap reference portion receiving Ic and comprising a first branch including a first transistor of a first type serially coupled to a second transistor of a second type, a second branch including a third transistor of the first type serially coupled to a fourth transistor of the second type, the band-gap reference portion being coupled to only one active node of the regulator portion, the first and second branches forming a current mirror carrying a total current of about Ic/2, and further comprising a third branch in parallel with the first and second branches and carrying a current of substantially Ic/2.

2. The apparatus of claim 1 wherein an input of the first transistor is coupled to an input of the third transistor without adding significant resistance and an input of the second transistor is coupled to an input of the fourth transistor and to a band-gap reference voltage output.

3. The apparatus of claim 1 wherein the first transistor of the first branch of the regulator portion has a first emitter area and the second transistor of the second branch of the regulator portion has a second emitter area and wherein the first emitter area is N times the second emitter area where $1 \leqq N \leqq 20$.

4. The apparatus of claim 3 wherein $4 \leqq N \leqq 16$.

5. The apparatus of claim 1 wherein the second transistor of the first branch of the band-gap reference portion has a first emitter area and the second transistor of the second branch of the band-gap reference portion has a second emitter area which is M times the first emitter area where $1 \leqq M \leqq 20$.

6. The apparatus of claim 5 wherein $4 \leqq M \leqq 16$.

7. The apparatus of claim 1 wherein the regulator portion comprises a first branch including a first transistor of the second type serially coupled to a second transistor of the second type, a second branch including a third transistor of the second type serially coupled to a fourth transistor of the second type, wherein inputs of the first and third transistors are coupled together and an input of the second transistor is coupled to the second branch of the regulator portion and an input of the fourth transistors is coupled to the first branch of the regulator portion, and wherein the regulator portion further comprises a fifth transistor of the first type and a sixth transistor of the first type arranged in parallel with inputs joined, and wherein the first branch of the regulator portion is coupled to the fifth transistor and the sixth transistor is coupled to the band-gap reference portion for supplying Ic thereto, wherein the sixth transistor has an emitter area which is P times larger than an emitter area of the fifth transistor and the first branch of the regulator portion carries a current Ia which is about equal Ic/P, wherein the second branch of the band-gap reference portion carries a current Ib which is substantially Ic/4, and wherein the first branch of the regulator portion has a series coupled resistor of value Ra and the first branch of the band-gap reference portion has a series coupled resistor of value Rb and wherein Ra/Rb is substantially equal to (P/4)*[ln(N)/ln(M)].

8. The apparatus of claim 7 wherein [ln(N)/ln(M)] is substantially equal to unity.

9. The apparatus of claim 7 wherein N and M are substantially equal.

10. A method of operating an electrical apparatus having a regulator portion with a first branch having a first transistor and a second branch having a second transistor, the regulator portion for providing a substantially constant current of predetermined magnitude Ic and a band-gap reference portion receiving the constant current and comprising a first branch including a first transistor of a first type serially coupled to a second transistor of a second type, a second branch including a third transistor of the first type serially coupled to a fourth transistor of the second type, and a third branch in parallel with the first and second branches, the band-gap reference portion being coupled to only one active node of the regulator portion, said method comprising the steps of operating the first and second branches as a current mirror carrying a total current of about Ic/2, and operating the third branch to carry a current of substantially Ic/2.

11. The method of claim 10 wherein an input of the first transistor is coupled to an input of the third transistor without adding significant resistance and an input of the second transistor is coupled to an input of the fourth transistor and to a band-gap reference voltage output.

12. The method of claim 10 wherein the first transistor of the first branch of the regulator portion has a first emitter area and the second transistor of the second branch of the regulator portion has a second emitter area and wherein the first emitter area is N times the second emitter area where $1 \leqq N \leqq 20$.

13. The method of claim 10 wherein the second transistor of the first branch of the band-gap reference portion has a first emitter area and the second transistor of the second branch of the band-gap reference portion has a second emitter area which is M times the first emitter area where $1 \leqq M \leqq 20$.

* * * * *